US010889358B2

(12) United States Patent
Wong et al.

(10) Patent No.: US 10,889,358 B2
(45) **Date of Patent: *Jan. 12, 2021**

(54) MOUNTING ASSEMBLY FOR POSITIONING STERN-MOUNTED PROPULSION UNITS WITH A FORWARD CONVERGENCE

(71) Applicant: Marine Canada Acquisition Inc., Richmond (CA)

(72) Inventors: Ray Tat Lung Wong, Richmond (CA); Neal Wesley Denis Wood, Coquitlam (CA)

(73) Assignee: Marine Canada Acquisition Inc., Richmond (CA)

( * ) Notice: Subject to any disclaimer, the term of this patent is extended or adjusted under 35 U.S.C. 154(b) by 0 days.

This patent is subject to a terminal disclaimer.

(21) Appl. No.: 16/247,930

(22) Filed: Jan. 15, 2019

(65) Prior Publication Data

US 2019/0144094 A1 May 16, 2019

Related U.S. Application Data

(63) Continuation-in-part of application No. 14/890,888, filed as application No. PCT/CA2014/050457 on May 14, 2014, now Pat. No. 10,202,179.

(60) Provisional application No. 61/823,271, filed on May 14, 2013.

(51) Int. Cl.

| | |
|---|---|
| ***B63H 5/125*** | (2006.01) |
| ***B63H 20/08*** | (2006.01) |
| ***B63H 20/12*** | (2006.01) |
| ***B63H 20/02*** | (2006.01) |
| ***B63B 1/10*** | (2006.01) |
| ***B63H 20/06*** | (2006.01) |
| *B63H 20/00* | (2006.01) |

(52) U.S. Cl.
CPC ..... *B63H 20/12* (2013.01); *B63B 1/10* (2013.01); *B63H 20/02* (2013.01); *B63H 20/06* (2013.01); *B63H 2020/003* (2013.01)

(58) Field of Classification Search
CPC ..... B63H 20/02; B63H 20/06; B63H 20/12; B63H 2020/02; B63H 2020/08
USPC ..... 440/53, 55, 61 S
See application file for complete search history.

(56) References Cited

U.S. PATENT DOCUMENTS

| | | | | |
|---|---|---|---|---|
| 3,665,885 A * | 5/1972 | Javes | B63B 1/121 114/61.2 |
| 9,156,535 B2 * | 10/2015 | Mizutani | B63H 25/42 |
| 2011/0086560 A1 * | 4/2011 | Ulgen | B63H 20/12 440/61 S |

OTHER PUBLICATIONS

Machine translation of JPH02179597 A (Suzuki Motor Co), originally published Jul. 12, 1990, retrieved online Jun. 10, 2020, Retrieved from: Espacenet Worldwide Database.

(Continued)

*Primary Examiner* — Daniel V Venne
(74) *Attorney, Agent, or Firm* — Berenato & White, LLC

(57) ABSTRACT

There is provided a mounting assembly for a marine vessel having a pair of stern-mounted propulsion units. The assembly includes a pair of angle-setting members which forwardly angle the propulsion units towards a bow of the marine vessel when each propulsion unit is at the center of its total steering range. Each propulsion unit has a line of action of its propulsion force. The lines of action of the propulsion units intersect each other between a center of rotation of the marine vessel and a stern of the marine vessel when the propulsion units are steered forwardly towards each other.

20 Claims, 13 Drawing Sheets

(56) References Cited

OTHER PUBLICATIONS

Machine translation of JPH02179597 A (Suzuki Motor Co), originally published Jul. 12, 1990, retrieved online Jun. 10, 2020, Retrieved from: Japan Platform for Patent Information (J-PlatPat) Database.

* cited by examiner

Increased 72 degree range

MOUNTING ASSEMBLY FOR POSITIONING STERN-MOUNTED PROPULSION UNITS WITH A FORWARD CONVERGENCE

FIELD OF THE INVENTION

There is provided a mounting assembly. In particular, there is provided a mounting assembly for positioning stern-mounted propulsion units of marine vessels with a forward convergence.

DESCRIPTION OF THE RELATED ART

U.S. Pat. No. 6,234,853, which issued to Lanyi et al. on May 22, 2001, discloses a docking system which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions. The docking or maneuvering system uses two marine propulsion units to respond to an operator's command signal and allows the operator to select forward or reverse commands in combination with clockwise or counterclockwise rotational commands either in combination with each other or alone.

U.S. Pat. No. 7,267,068, which issued to Bradley et al. on Sep. 11, 2007, discloses a marine vessel which is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel. Internal combustion engines are provided to drive the marine propulsion devices. The steering axes of the two marine propulsion devices are generally vertical and parallel to each other. The two steering axes extend through a bottom surface of the hull of the marine vessel.

BRIEF SUMMARY OF INVENTION

There is provided a mounting assembly for a marine vessel having a bow, a stern, a center of rotation and a pair of stern-mounted propulsion units, each propulsion unit having a total steering range. The assembly comprises a pair of angle-setting members which forwardly angle the propulsion units towards the bow of the marine vessel when each propulsion unit is at the center of the total steering range. Each propulsion unit may have a line of action of its propulsion force. The lines of action of the propulsion units may intersect each other between the center of rotation of the marine vessel and the stern of the marine vessel when the propulsion units are steered forwardly towards each other. The marine vessel may be a twin-hulled vessel.

The marine vessel may have a longitudinal axis. The angle-setting members may angle the propulsion units inwardly and forwardly in the range of greater than 0 degrees and less than 30 degrees relative to the longitudinal axis of the marine vessel. The angle-setting members may angle the propulsion units inwardly and forwardly in the range of 5 to 10 degrees relative to the longitudinal axis of the marine vessel. The angle-setting members may angle the propulsion units inwardly and forwardly by 6 degrees relative to the longitudinal axis of the marine vessel. Each of the angle-setting members may comprise an inwardly biased tiller arm. Propeller axes of the propulsion units may be forwardly convergent relative to the tiller arms when the tiller arms align parallel with the longitudinal axis of the marine vessel.

The angle-setting members may be wedge-shaped. Each angle-setting member may have a thin end and a thick end. The thick ends of the angle-setting members may be positioned to face each other. There may be a pair of stern brackets which are operatively connected to respective ones of the propulsion units. The angle-setting members may be connected to the stern brackets. The angle-setting members may be integrally connected to and integrally formed with the stern brackets.

The marine vessel may have a transom. There may be a pair of stern brackets operatively connected to respective ones of the propulsion units. The angle-setting members may be connected to the stern brackets. The angle-setting members may be interposed between the stern brackets and the transom. Each angle-setting member may have a pair of spaced-apart apertures. There may be a plurality of fasteners. Each of the fasteners may extend through a respective one of the apertures. The fasteners may connect the stern brackets, the angle-setting members and the transom together. The angle-setting members may comprise angled portions of the transom. Each angle-setting member may comprise an angled stern bracket that connects to the transom.

There is also provided a mounting assembly for a marine vessel having a pair of stern-mounted propulsion units with a total steering range. The assembly comprises a pair of stops which allow the propulsion units to steer to a maximum steering range. The maximum steering range is one half of the total steering range plus an angle $\beta$ on a first side and one half of the total steering range less the angle $\beta$ on a second side.

BRIEF DESCRIPTION OF DRAWINGS

The invention will be more readily understood from the following description of preferred embodiments thereof given, by way of example only, with reference to the accompanying drawings, in which.

DESCRIPTIONS OF THE PREFERRED EMBODIMENTS

Figure 1:
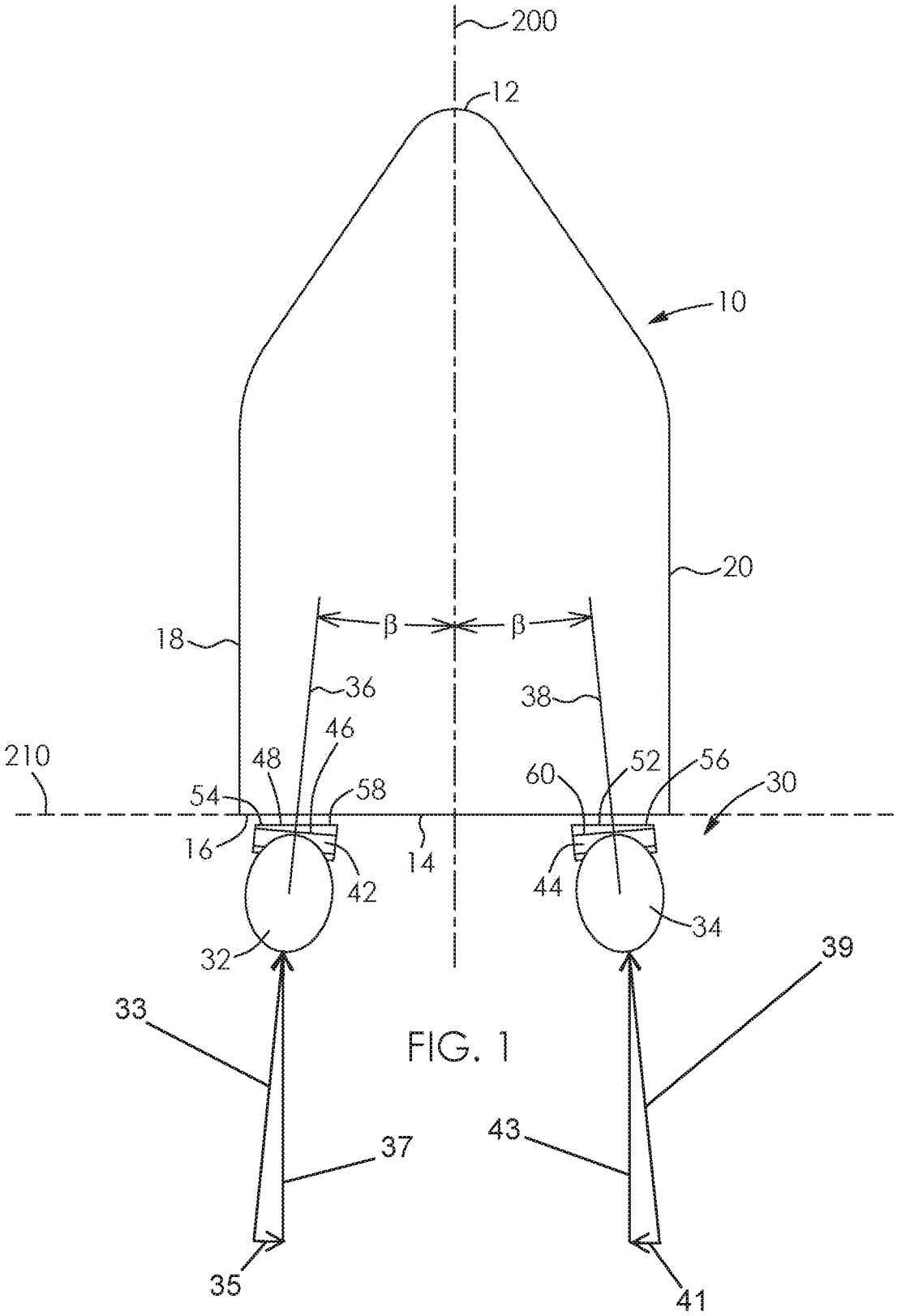
FIG. 1 is a simplified, top plan schematic view of a marine vessel having a pair of outboard engines and a mounting assembly therefor according to one aspect, the engines being positioned in the center of their steering ranges.

Referring to the drawings and first to FIG. 1, there is shown a mounting assembly 30 for a marine vessel 10. The vessel 10 has a bow 12, a stern 14 which is spaced-apart from the bow, a transom 16 located at the stern, a port side 18 and a starboard side 20 which is spaced-apart from the port side. The sides 18 and 20 of the vessel 10 extend from the stern 14 to the bow 12. The sides 18 and 20 of the vessel 10 are further spaced-apart in this example compared to a more conventional, narrower beamed vessel. Alternatively, the vessel 10 may be stern heavy compared to a conventional vessel. The vessel 10 has a longitudinal axis or centerline 200 which extends from the stern 14 to the bow 12 and which is situated between the sides 18 and 20 of the vessel. The vessel 10 has a lateral axis 210 that extends perpendicular to the centerline 200 from the side 18 to the side 20.

Figure 7:
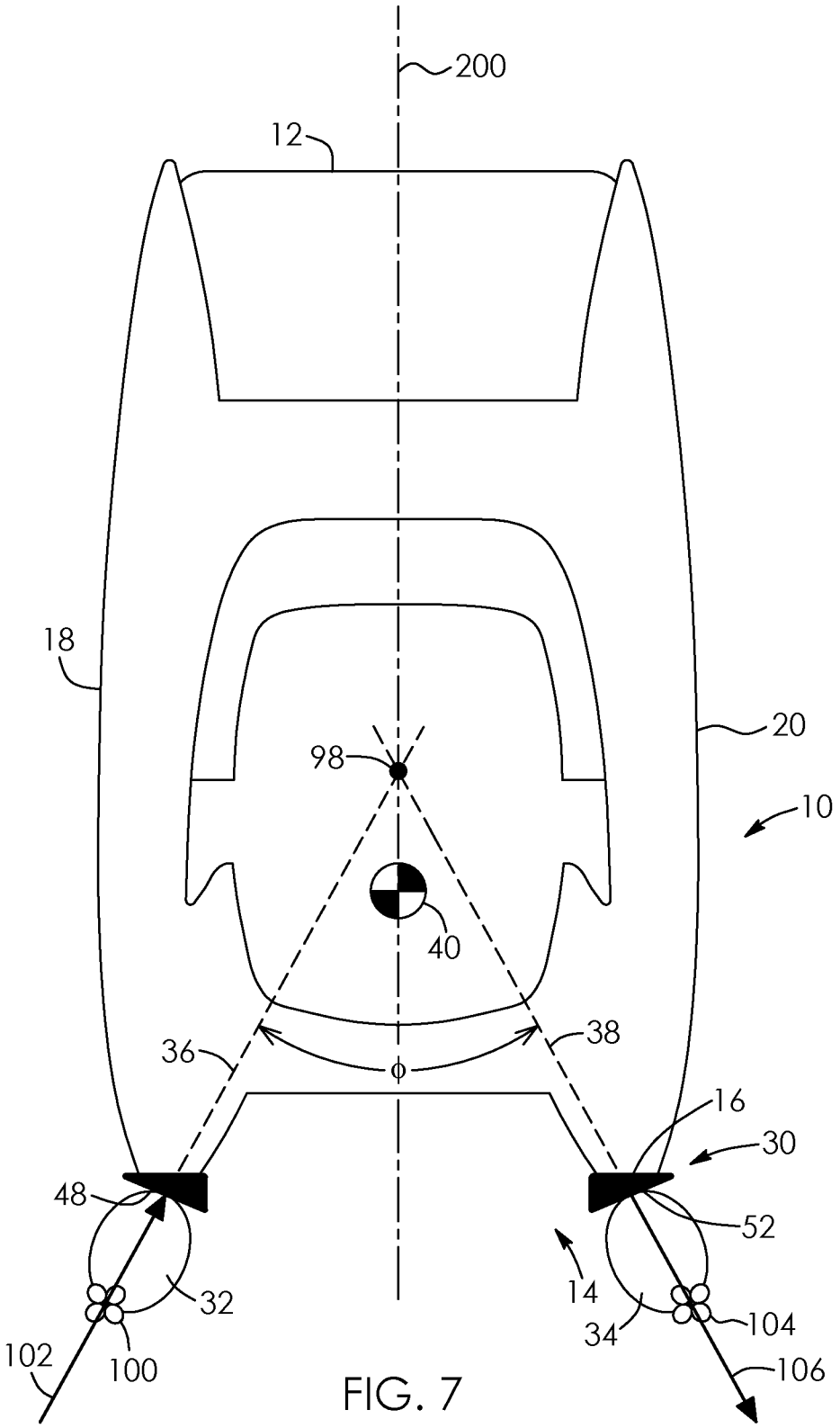
FIG. 7 is a simplified top plan schematic view of the vessel of FIG. 2 showing a port engine generating a forward propulsion force and a starboard engine generating a rearward propulsion force, lines of action of the propulsion forces of the engines intersecting forward of a center of rotation of the vessel.
Figure 8:
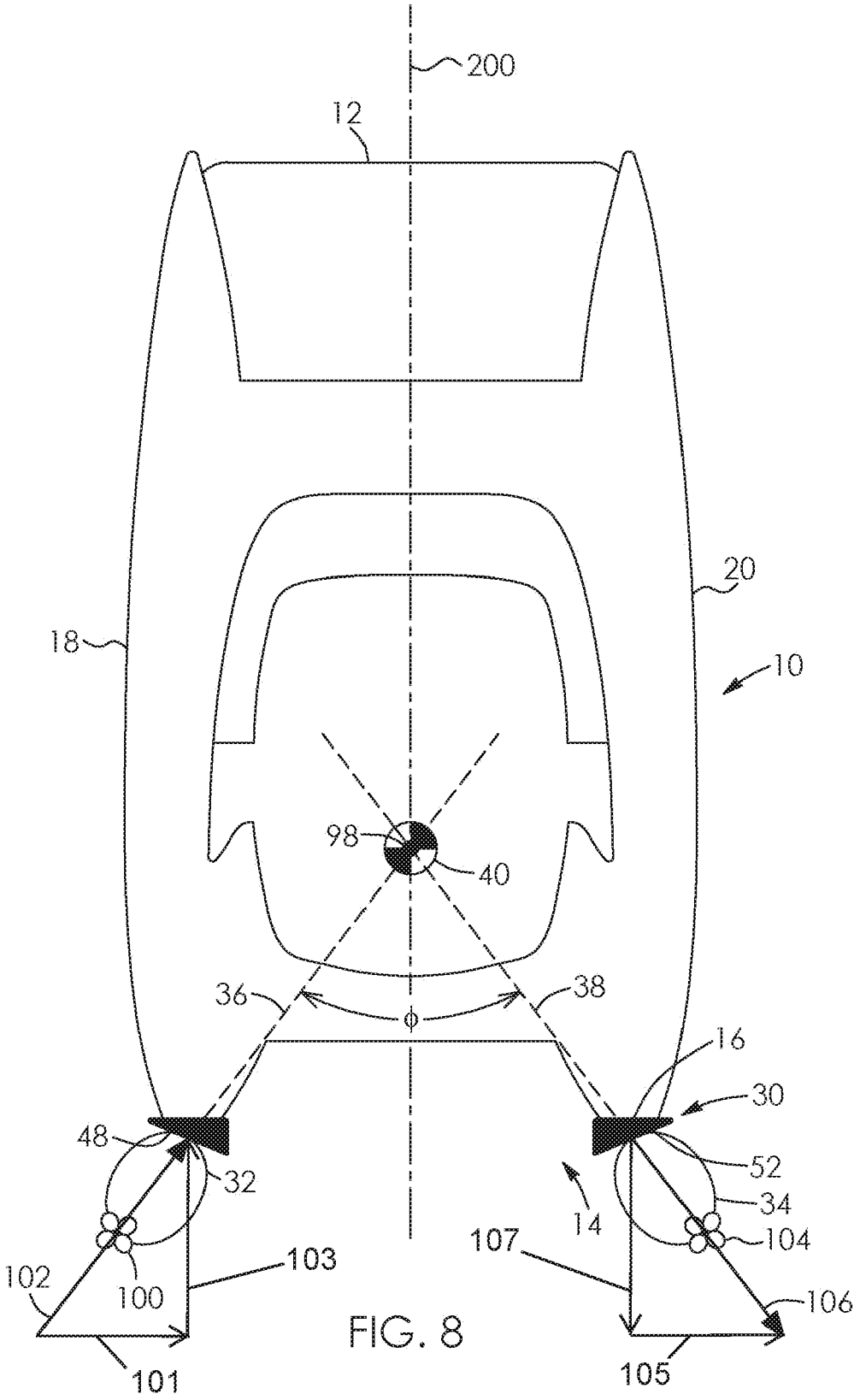
FIG. 8 is a simplified top plan schematic view of the vessel of FIG. 2 showing the port engine generating a forward propulsion force and the starboard engine generating a rearward propulsion force, lines of action of the propulsion forces of the engines intersecting at the center of rotation of the vessel.
Figure 9:
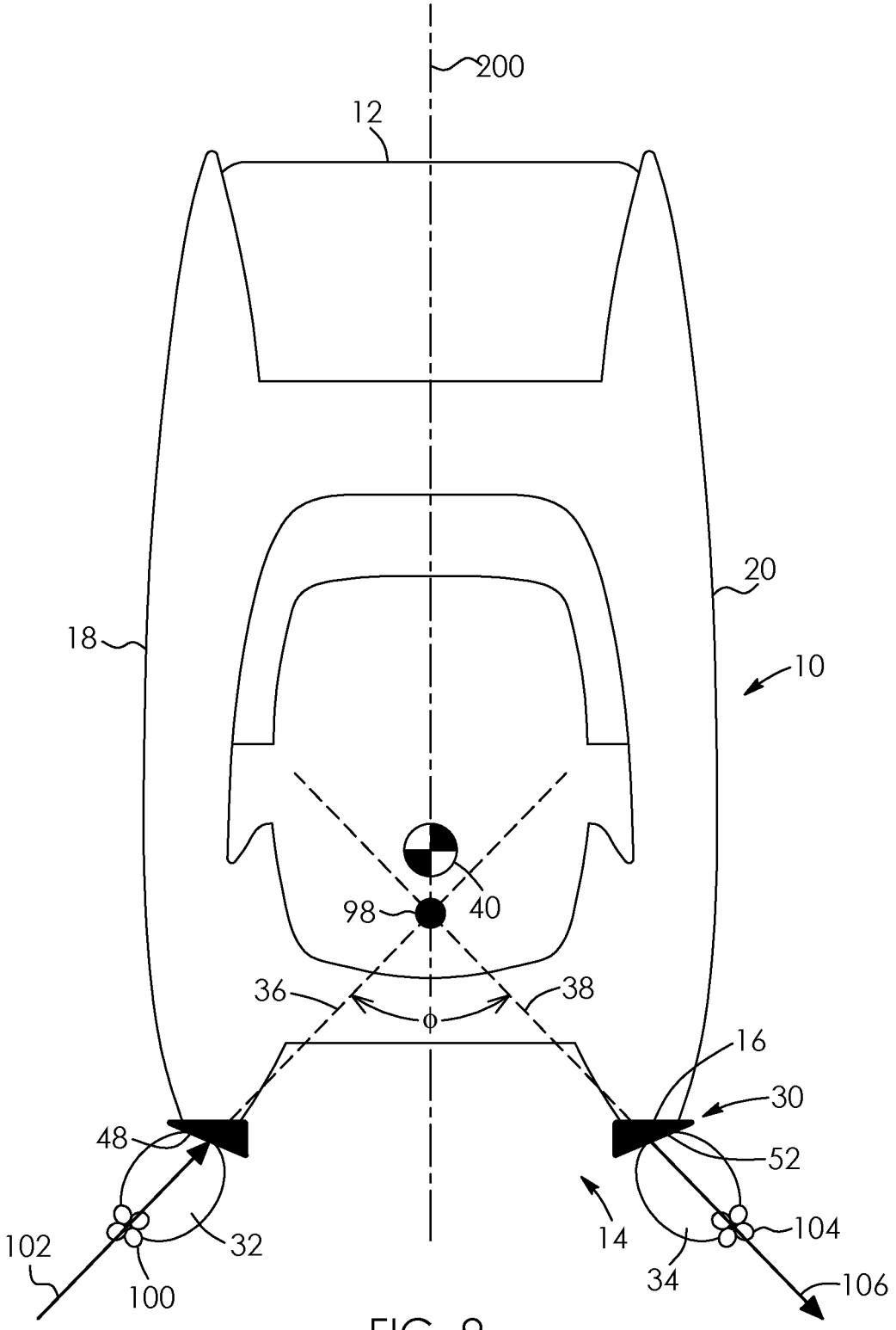
FIG. 9 is a simplified top plan schematic view of the vessel of FIG. 2 showing the port engine generating a forward propulsion force and the starboard engine generating a rearward propulsion force, lines of action of the propulsion forces of the engines intersecting rearward of the center of rotation of the vessel.

The vessel 10 has a plurality of engines, in this example a pair of engines in the form of a port engine 32 located adjacent to the port side 18 and a starboard engine 34 located adjacent to the starboard side 20. The engines 32 and 34 have propeller axes 36 and 38, respectively, as seen in FIG. 1, which correspond to the lines of action of their propulsion forces. As seen in FIGS. 7 to 9, the vessel 10 has a center of rotation 40, which may correspond to the center of gravity of the vessel in its static state. It is possible to apply the improvement to vessels that have three engines, where the outer two engines are far apart from each other. Angling the outer engines in a manner similar to the two engine embodiment illustrated herein can achieve a similar result. This description focuses on illustrating the improvement with two engines.

Referring back to FIG. 1, the mounting assembly 30 has a pair of stern brackets 42 and 44 which are operatively connected to the outboard engines 32 and 34, respectively. One of the stern brackets 42 is shown in greater detail in FIG. 3. The stern bracket 42 has a connector portion 46 facing the transom 16 of the vessel 10, shown in FIG. 1. The outboard engines and stern brackets in this embodiment are conventional, with parts and functionings well known to those skilled in the art, and therefore will not be described in further detail.

Figure 3:
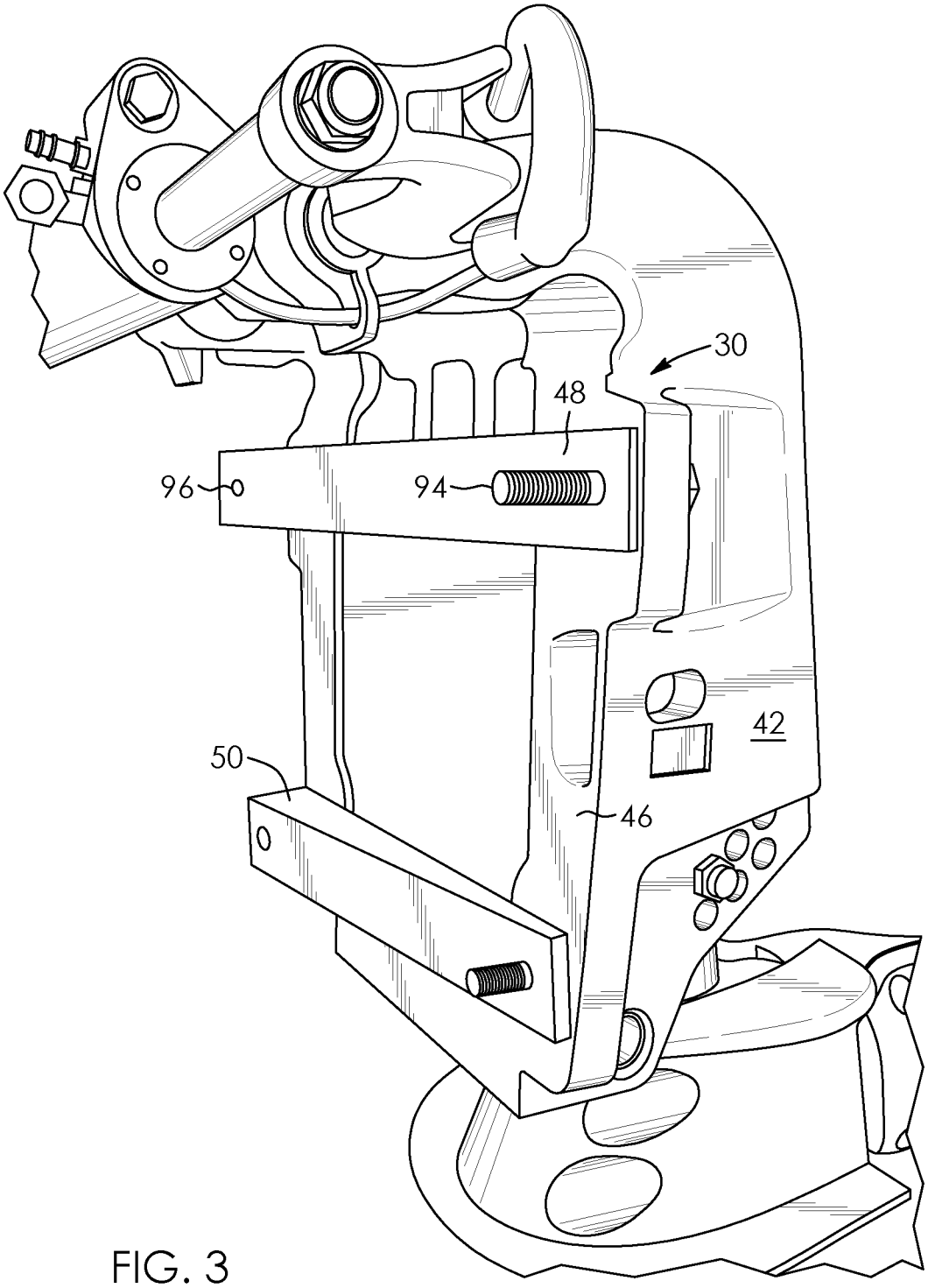
FIG. 3 is a front, side perspective view of a stern bracket and a pair of spaced-apart angle-setting members connected thereto, the angle-setting members being part of the mounting assembly of FIG. 1.

The mounting assembly 30 includes a plurality of angle-setting members, in this example a pair of spaced-apart members for each engine, as shown by members 48 and 50 for the engine 32 in FIG. 3. Only upper members 48 and 52 for the respective engines 32 and 34 are seen in FIG. 1. The angle-setting members are configured to position the engines 32 and 34 with a slight forward convergence that is angled towards the centerline 200 when the engines are at the center of their steering ranges, thus altering the steering angles of the engines relative to the centerline of the vessel.

Each angle-setting member is wedge-shaped in this example, with a thin end and a thick end that is thicker than the thin end. This is shown in FIG. 1 by thin ends 54 and 56 and thick ends 58 and 60 for the members 48 and 52, respectively. The thin ends 54 and 56 of the angle-setting members are positioned adjacent to respective sides 18 or 20 of the vessel 10. The thick ends 58 and 60 of the angle-setting members are positioned to face each other.

Figure 4:
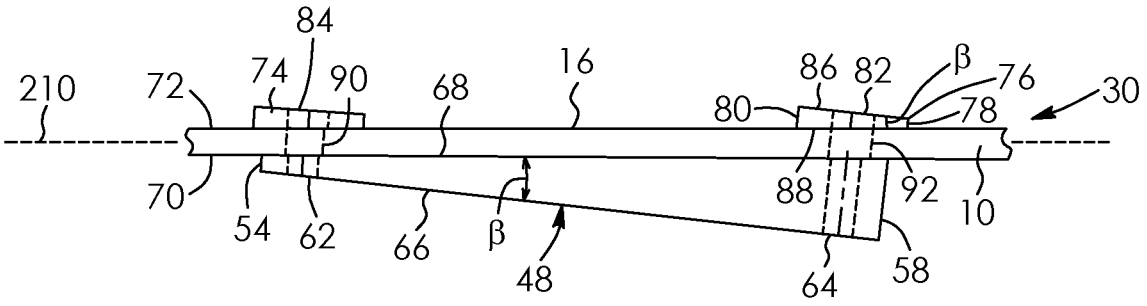
FIG. 4 is a top plan view of part of the mounting assembly of FIG. 1 connected to a transom of the vessel of FIG. 1, the transom being shown in fragment, the mounting assembly showing an angle-setting member and a pair of washers.

As seen in FIG. 4, the angle-setting member 48 has a pair of spaced-apart apertures 62 and 64, in this example, extending therethrough adjacent to its ends 54 and 58, respectively. The angle-setting member 48 in this example has an outer face 66, which extends between and is perpendicular to the ends 54 and 58, and an inner face 68 which is spaced-apart from the outer face. The inner face 68 extends between the ends 54 and 58 at a non-perpendicular angle with respect to the ends in this example although this is not essential. As seen in FIG. 1, the angle-setting members 48 and 52 are interposed between the stern brackets 42 and 44 and the transom 16 in this example, with the inner face 68 of the angle-setting member 48 abutting an outer surface 70 of the transom as seen in FIG. 4. The outer face 66 of the angle-setting member 48 abuts the connector portion 46 of the bracket 42 as shown in FIG. 3.

Figure 5:
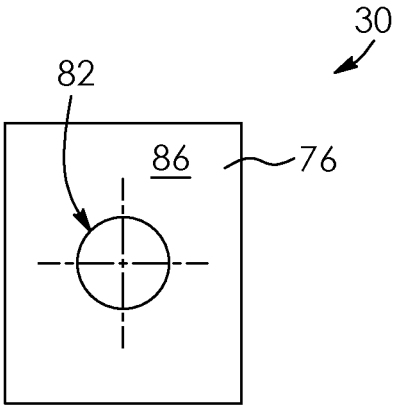
FIG. 5 is a rear, elevational view of a washer of the mounting assembly of FIG. 4.
Figure 6:
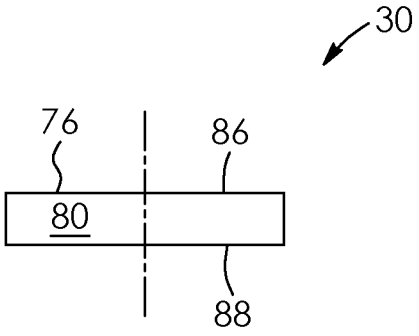
FIG. 6 is a side view of the washer of FIG. 5.

As seen in FIGS. 4 to 6, the angle-setting member 48 includes a pair of wedge-shaped washers 74 and 76. Each washer has a thin end, a thick end which is thicker than the thin end, and a central aperture extending therethrough, as shown by thin end 78, thick end 80 and aperture 82 for the washer 76 in FIG. 4. The aperture 82 of the washer 76 aligns with the aperture 64 of the angle-setting member 48 and an aperture 84 of the washer 74 aligns with the aperture 62 of the angle-setting member 48. The washer 76 in this example has a first face 86, which extends between and is perpendicular to the ends 78 and 80, and a second face 88 which is spaced-apart from the first face. The face 88 extends between the ends 54 and 58 of the angle-setting member 48 at a non-perpendicular angle with respect to the ends in this example and abuts an inner surface 72 of the transom 16. The transom has a pair of spaced-apart apertures 90 and 92 extending therethrough for the angle-setting member 48 in this example. The washer 76 and the angle-setting member 48 are shaped such that the face 66 of the member 88 and the face 86 of the washer 76 extend substantially parallel to each other when the washer and the angle-setting member abut the transom 16. However, the exact shape of the washer is not essential. The washer 74 is similar in structure and function to the washer 76 and is accordingly not described in detail herein.

As seen in FIG. 3, the mounting assembly 30 includes a plurality of fasteners, in this example a pair of bolts 94 and 96 for the angle-setting member 48. The bolts extend through the bracket 42, the apertures 62 and 64 of the angle-setting member 48, the apertures 90 and 92 of the transom 16 and the apertures 84 and 82 of the washers 74 and 76, and connect the bracket 42 to the transom 16. As seen in FIG. 1, the angle-setting members 48 and 52 thus connect to the stern brackets 42 and 44.

Referring to FIG. 1, the angle-setting member 48 causes the propeller axis 36 of the port engine 32 to angle towards the starboard side 20 of the vessel 10 when the port engine 32 is at the center of its steering range as illustrated. Likewise, the angle-setting member 52 causes the propeller axis 38 of the starboard engine 34 to angle towards the port side 18 when the starboard engine 34 is at the center of its steering range. According to one embodiment, each propeller axis is inwardly and forwardly angled towards the centerline 200 at an angle β relative to the centerline when the engines 32 and 34 are positioned to the midpoint or center of their steering ranges. As a result, when the port engine 32 (a first propulsion unit at the stern 14 of the marine vessel 10) is positioned at the center of its steering range as shown in FIG. 1, the port engine 32 is positioned to exert, on the marine vessel 10, a first propulsion force 33 having a first lateral component 35 that is lateral relative to the marine vessel 10 and a first longitudinal component 37 that is longitudinal and forward relative to the marine vessel 10, and when the starboard engine 34 (a second propulsion unit at the stern 14 of the marine vessel 10) is positioned at the center of its steering range as shown in FIG. 1, the starboard engine 34 is positioned to exert, on the marine vessel 10, a second propulsion force 39 having a second lateral component 41 that is lateral relative to the marine vessel 10 and a second longitudinal component 43 that is longitudinal and forward relative to the marine vessel 10. The transverse component 35 is towards the starboard side 20, and the transverse component 41 is towards the port side 18. In this case and referring to FIG. 4, the outer face 66 of the angle-setting member 48 is also angularly spaced-apart from the lateral axis 210 of the vessel 10 and the inner face 68 of the angle-setting member 48 by angle β. It is practical to arrange both port and starboard angle β to be the same or symmetrical with respect to the centerline. The faces 86 and 88 of the washer 76 are also at angle β with respect to each other in this example.

Figure 2:
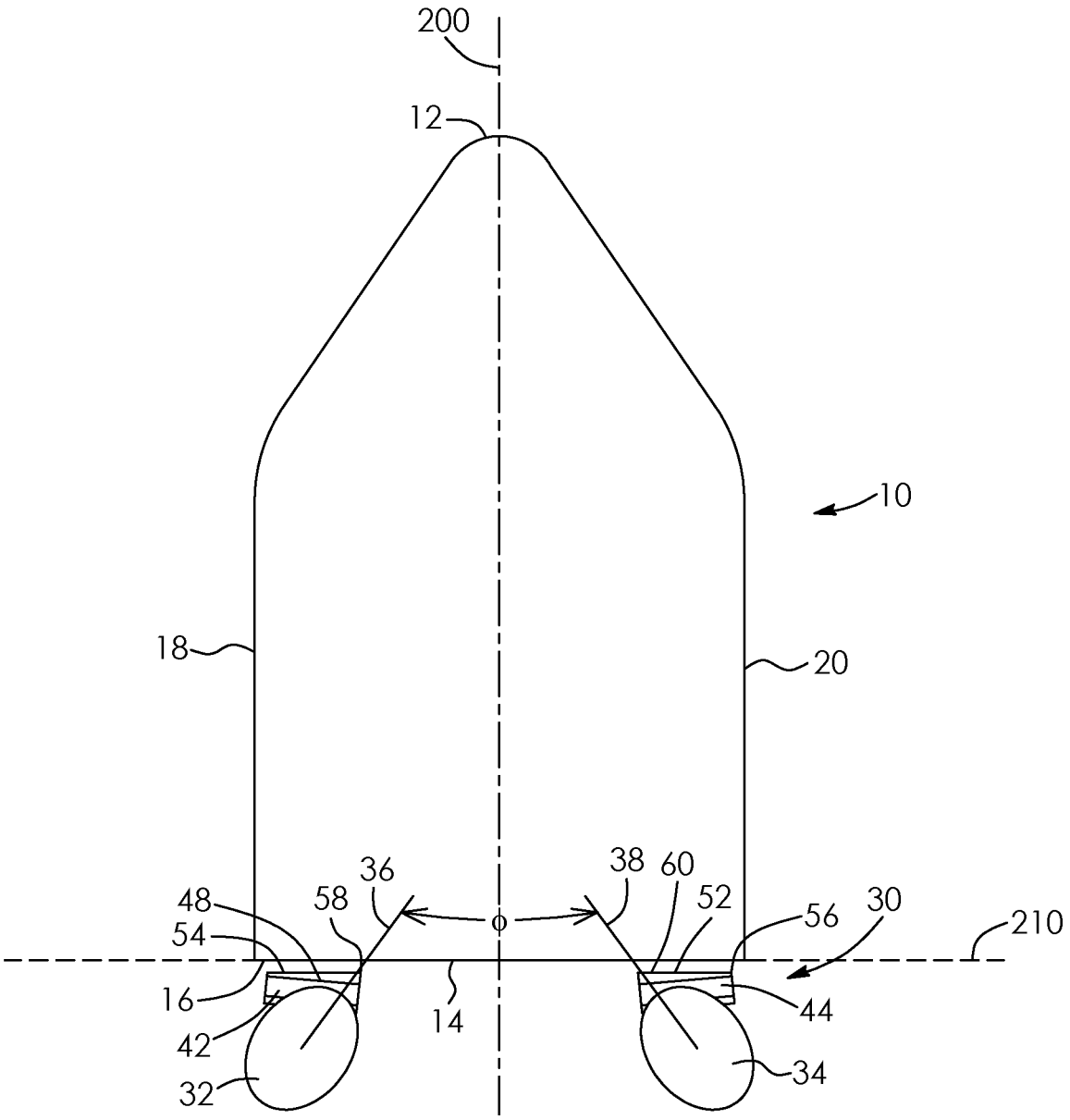
FIG. 2 is a simplified, top plan schematic view of the marine vessel of FIG. 1, the engines being steered towards each other at a maximum steering angle so that they fully forwardly converge towards each other.

According to one aspect, angle β is an angle within the range of 1 to 30 degrees. According to another aspect, angle β is an angle within the range of 5 to 15 degrees. According to a further aspect seen in FIGS. 1 and 2, angle β is substantially equal to 6 degrees, although other angles are possible. In this case and as seen in FIG. 2, when the engines 32 and 34 are steered to fully forwardly converge towards each other at the ends of their steering ranges, the angle of separation ϕ between the axes 36 and 38 is equal to 72 degrees. This is in contrast to a conventional engine arrangement where the angle of separation would typically only be 60 degrees. Due to physical limitations, each engine has a total steering range. The embodiments described above allow the total steering range to be maintained while having a biased steering range for the port side versus the starboard side. In general, one side has a steering range from center of (total_steering_range/2+β). The opposite side has a steering range from center of (total_steering_range/2−β).

Other angles may be used depending on the geometry of the vessel. For example, angle β may be equal to 12 degrees in another example. In this example, the steering range of the port engine extends within the range of 42 degrees to port and 18 degrees to starboard. The steering range of the starboard engine in this example extends within the range of 18 degrees to port and 42 degrees to starboard.

The propeller axes 36 and 38 of the engines 32 and 34 intersect at a point of intersection 98 along the centerline 200 of the vessel 10, as seen in FIG. 9, when the engines are fully steered towards the centerline. The angle-setting members 48 and 52 enable the point of intersection 98 to be further rearward towards the stern 14 of the vessel 10 compared to a conventional, wide-berthed or stern-heavy vessel. According to one aspect, the angle-setting members 48 and 52 are configured so that the point of intersection 98 is at or aft of the center of rotation 40. Thus, the angle-setting members 48 and 52 allow the point of intersection 98 to be aft of the center of gravity (or rotation) of the vessel 10. Positioning the point of intersection 98 rearward of the center of rotation 40 allows the vessel 10 to have counter-clockwise rotational adjustment while moving sideways, pure sideways movement and clockwise rotational adjustment while moving sideways.

In order to achieve pure sideways movement, a forward-moving propeller 100 of a first one of the engines, in this example port engine 32, has a line of action 102 with a forward for first) propulsion force as seen in FIG. 8. The forward for first) propulsion force along the line of action 102 has a first lateral component 101 that is lateral relative to the marine vessel 10 and a forward for first) longitudinal component 103 that is longitudinal and forward relative to the marine vessel 10. A reverse-moving propeller 104 of a second one of the engines, in this example the starboard engine 34, has a line of action 106 with a rearward for second) propulsion force. The rearward for second) propulsion force along the line of action 106 has a second lateral component 105 that is lateral relative to the marine vessel 10 and a rearward for second) longitudinal component 107 that is longitudinal and rearward relative to the marine vessel 10. Since the longitudinal components 103 and 107 of the two propulsion vectors, in this example the forward longitudinal component 103 of the forward propulsion force and the rearward longitudinal component 107 of the rearward propulsion force, are equal and opposite, the longitudinal components 103 and 107 cancel each other. The biased steering range created by the angle-setting members 48 and 52 allows the engine propellers 100 and 104 to be steered further towards each other. The angle-setting members 48 and 52 thus enable alignment of the point of intersection 98 with the center of rotation 40 as shown in FIG. 8. When the point of intersection 98 is at the center of rotation 40, the propulsion force 102 of the port engine 32 will not create a rotational moment on the vessel 10. Likewise, the propulsion force 106 of the starboard engine 34 will not create a rotational moment on the vessel 10. Since the longitudinal components 103 and 107 of the two propulsion vectors cancel each other, the lateral components 101 and 105 of the two propulsion vectors are summed to provide a pure sideways movement towards starboard from the point of view of FIG. 8. Thus, with the balanced values of steering angles, propulsion forces and moments, the vessel 10 may move purely sideways.

The biased steering range created by the angle-setting members 48 and 52 alternatively or additionally allows heading corrections during sideways movement. For example, as shown in FIG. 9, when the engine propellers 100 and 104 are steered fully towards each other so the point of intersection 98 is rearward of the center of rotation 40, the propulsion forces create a counter-clockwise rotation to the vessel 10 while moving sideways to starboard. Conversely, when the engine propellers 100 and 104 are steered towards each other so that the point of intersection 98 is forward of the center of rotation 40, as shown in FIG. 7, the propulsion forces create a clockwise rotation to the vessel while moving sideways to starboard. The biased steering range created by the angle-setting members 48 and 52 accordingly allows the vessel to have clockwise rotational adjustment and counter-clockwise rotational adjustment while moving sideways to starboard. Similarly, the biased steering range also allows the vessel to have clockwise rotational adjustment, counter-clockwise rotational adjustment and pure sideways movement while moving sideways to port.

Both clockwise rotational adjustment and counter-clockwise rotational adjustment while moving sideways are important in practice. External forces such as wind and current may cause the vessel to rotate unintentionally. Allowing the steering angles to be adjusted slightly provides a smooth maneuver as opposed to shifting gears and steering rudders with large angles. For vessel command functionality, it is desirable that the engines point towards the center of rotation 40, or what is generally referred to as the vessel's center of gravity. It is also desirable that the engine angle should not be at its maximum while pointing towards this center and the angle-setting members as herein described facilitate this objective.

Figure 10:
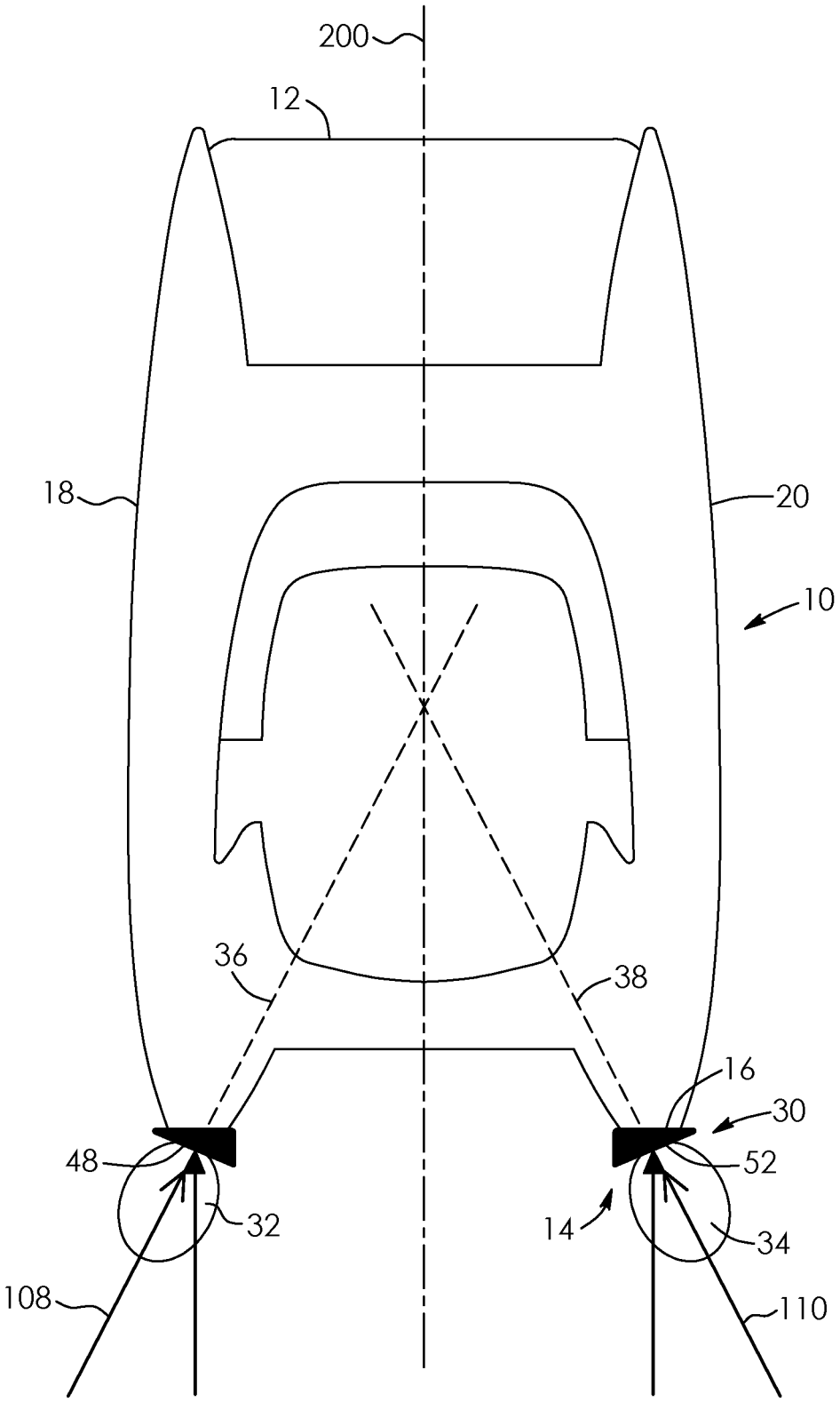
FIG. 10 is a simplified, top plan schematic view of the vessel of FIG. 1, with the engines being shown at the centers of their steering ranges and each engine generating a forward propulsion force.

As seen in FIG. 10, when it is desired to move the vessel 10 in a straight ahead forward direction, the angle-setting members 48 and 52 cause propulsion forces 108 and 110 to be "toed in" with respect to the engine mounts. The propeller axes 36 and 38 represent the centers of the steering ranges. This amount of toe in towards the centerline 200 for movement in a straight or steered direction can be dynamically adjusted by an electronic power steering system so that the engines can be parallel when desired.

Figure 11:
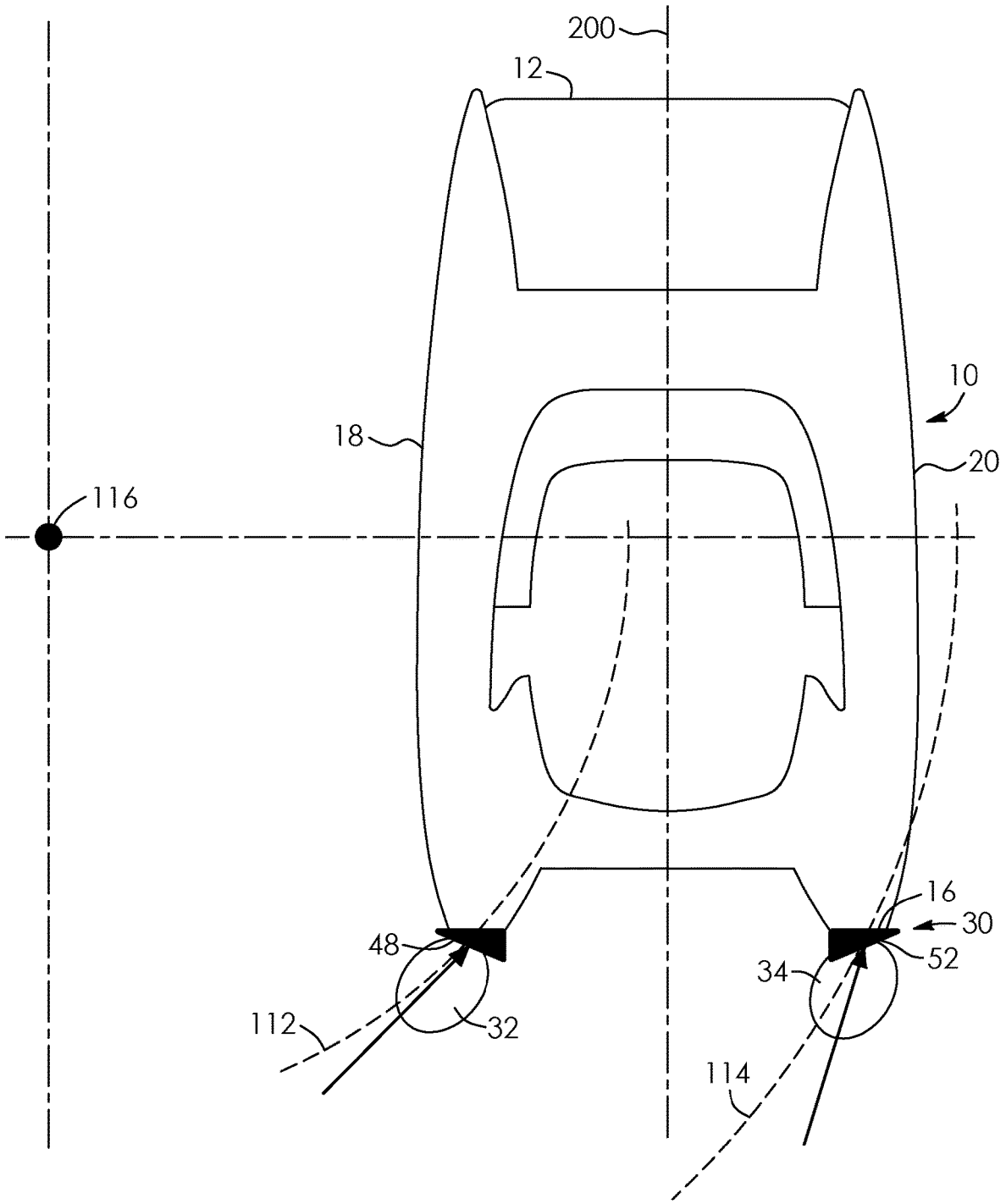
FIG. 11 is a simplified, top plan schematic view of the vessel of FIG. 1 showing the vessel performing a turning operation.

Referring to FIG. 11, the biased steering range is also useful for turning as it can incorporate Ackerman steering geometry. The arcs 112 and 114 represent the turning arcs that show the turning radii. The dot 116 represents the turning center of both engines 32 and 34. Especially when the vessel is moving slowly, this allows smoother steering with less slip. The amount of Ackerman geometry can be dynamically changed due to vessel speed, steering load, and aggressiveness settings by a user. The turning center of each engine can either coincide or be different. The angle-setting members 48 and 52 are not required to incorporate Ackerman steering geometry, but enable the maximum amount of Ackerman steering geometry to be greater.

Figure 12:
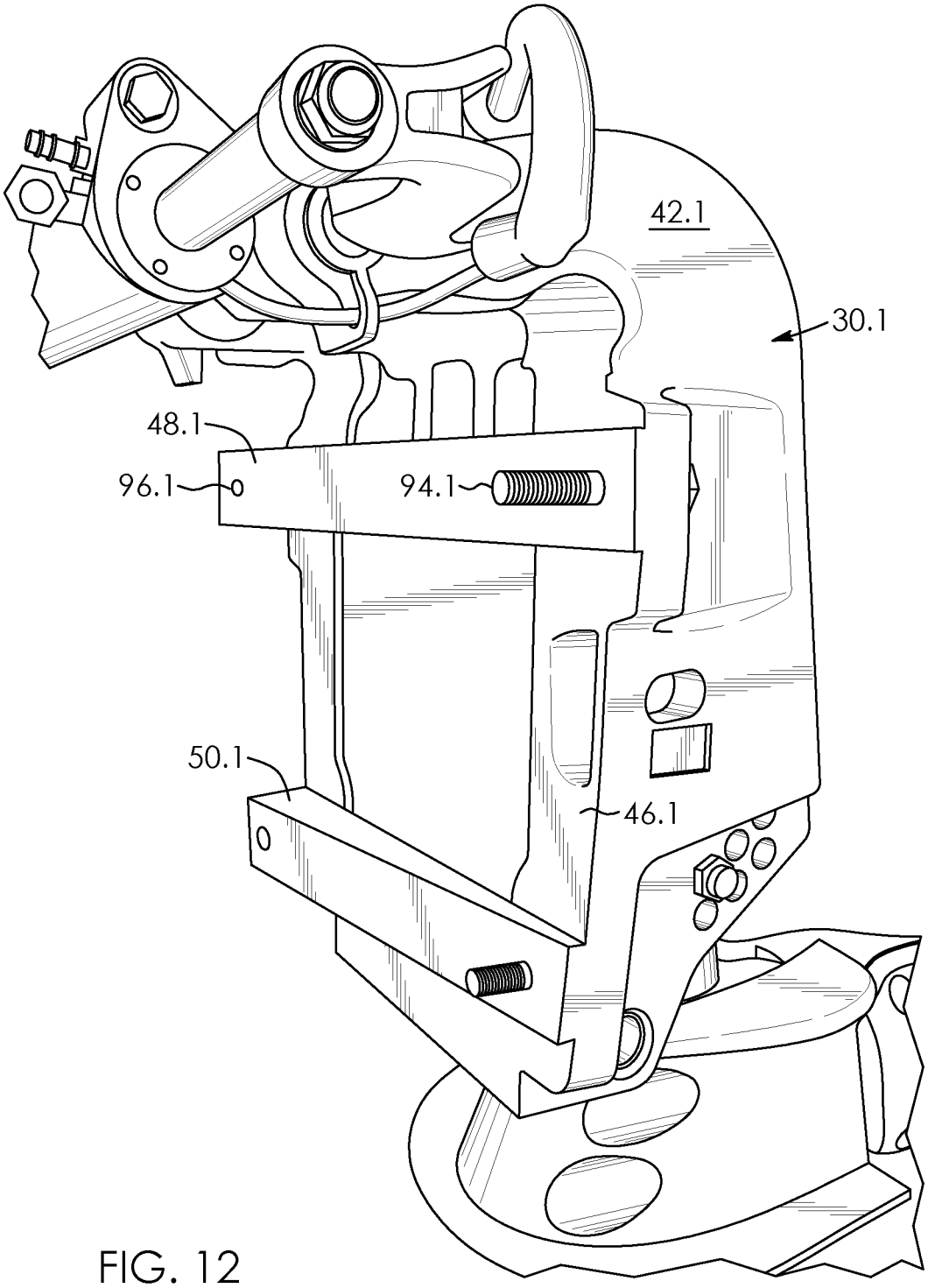
FIG. 12 is a front, side perspective view of a mounting assembly for a marine vessel according to a second aspect, the assembly having angle-setting members integrally connected to and integrally formed with the stern bracket.

FIG. 12 shows a mounting assembly 30.1 according to a second aspect. Like parts have like numbers and functions are the same as for the assembly 30 shown in FIGS. 1 to 11 with the addition of "0.1". However angle-setting members 48.1 and 50.1 are integrally connected to and are integrally formed with a stern bracket 42.1 in this example. In this case each angle-setting member comprises an angled stern bracket.

Figure 13:
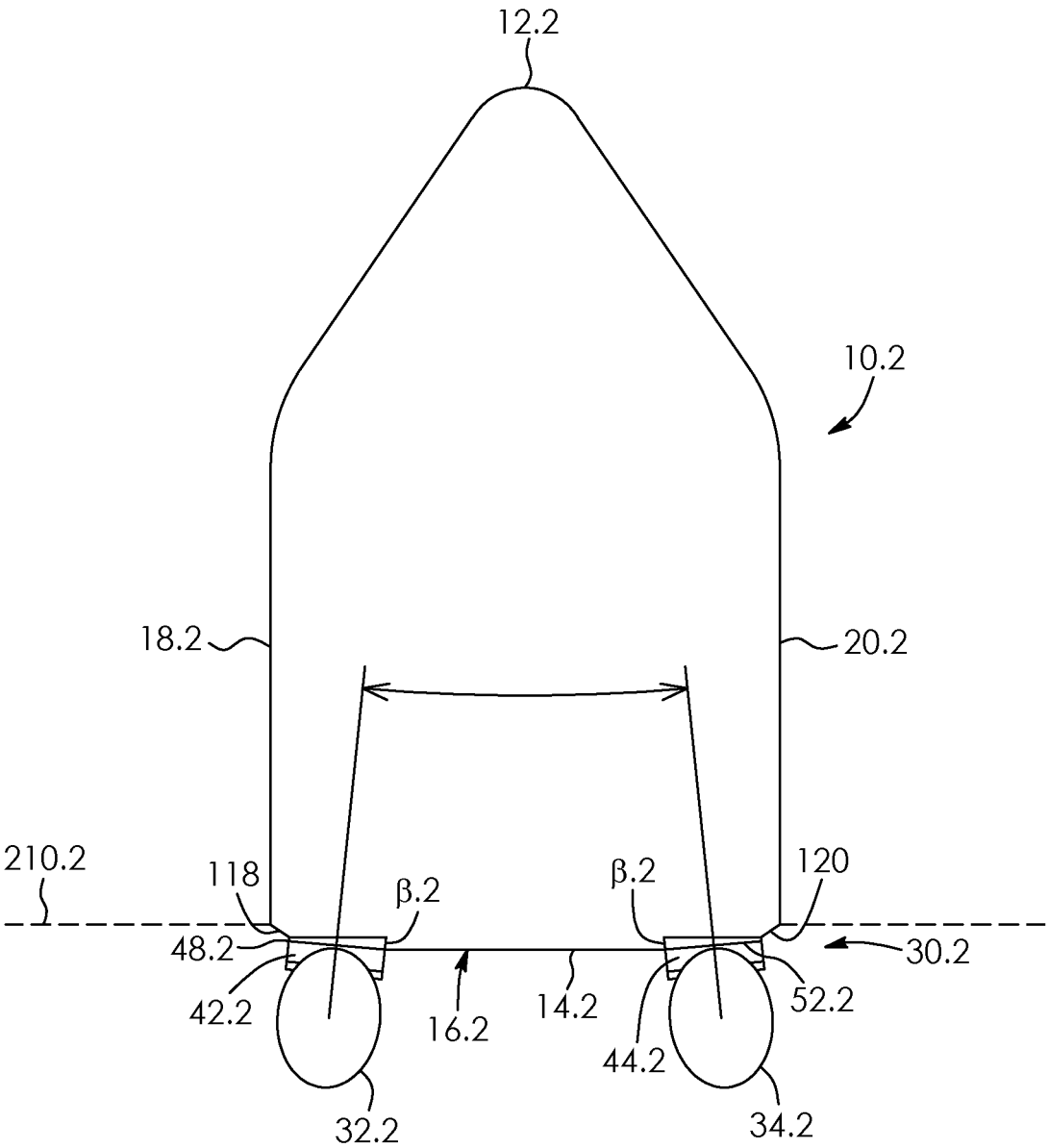
FIG. 13 is a simplified, top plan schematic view of a marine vessel and mounting assembly according to a third aspect, the mounting assembly having angle-setting members in the form of outwardly angled portions of a transom.

FIG. 13 shows a mounting assembly 30.2 and vessel 10.2 according to a third aspect. Like parts have like numbers and functions as the assembly 30 and vessel 10 shown in FIGS. 1 to 11 with the addition of "0.2". However angle-setting members 48.2 and 52.2 comprise outwardly angled portions 118 and 120 of a transom 16.2. The angled portions are each located adjacent to a respective one of sides 18.2 and 20.2.

Figure 14:
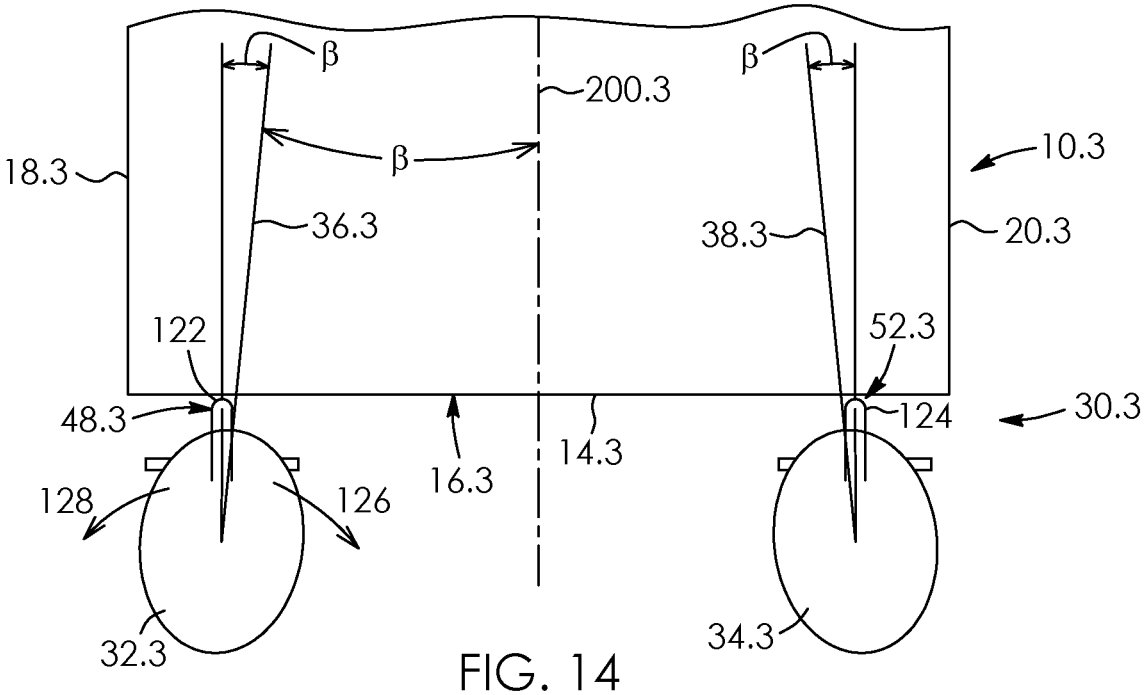
FIG. 14 is a simplified, top plan schematic view of a marine vessel having a pair of outboard engines, the vessel being shown in fragment, and a mounting assembly therefor according to a fourth aspect, the assembly having inwardly-biased tillers.
Figure 15:
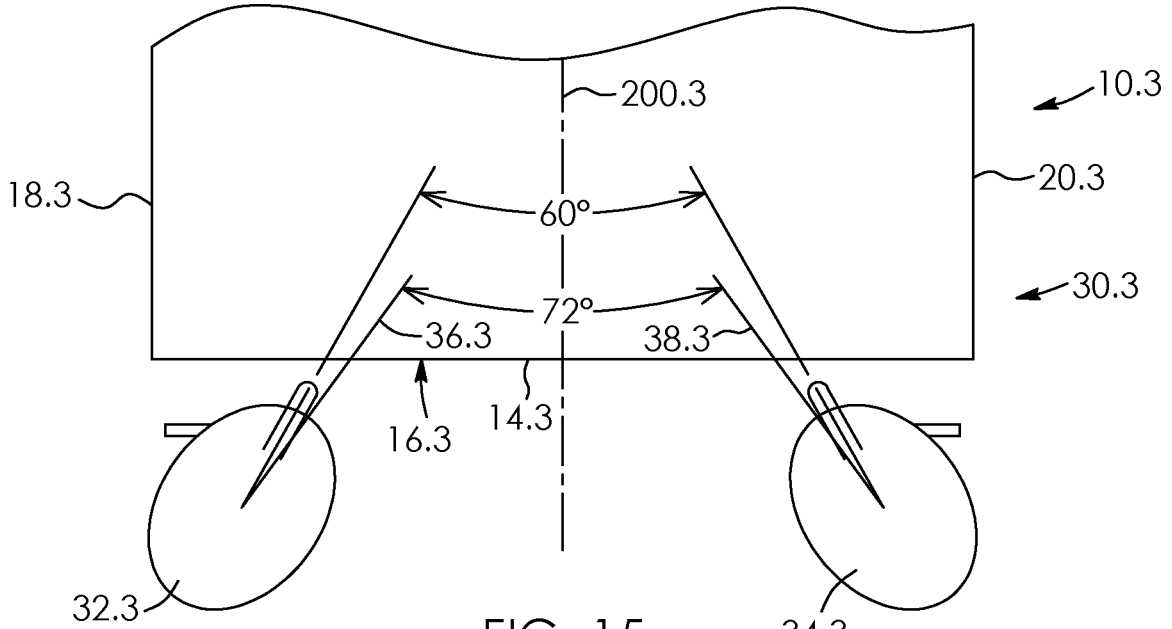
FIG. 15 is a simplified, top plan schematic view of the marine vessel and mounting assembly of FIG. 14, the engines being steered towards each other at a maximum steering angle so that they fully forwardly converge towards each other.

FIGS. 14 and 15 show a mounting assembly 30.3 and vessel 10.3 according to a fourth aspect. Like parts have like numbers and functions as the assembly 30 and vessel 10 shown in FIGS. 1 to 11 with the addition of "0.3". However, angle-setting members 48.3 and 52.3 comprise biased tillers (or tiller arms) 122 and 124. In this configuration, engines 32.3 and 34.3 are configured such that when the tillers 122 and 124 are held parallel with a centerline 200.3 of the vessel 10.3, propeller axes 36.3 and 38.3 of the engines are forwardly convergent towards the centerline at angles $\beta$, each of which is equal to 6 degrees in this example.

In a further alternative, the tillers may be configured in an unbiased conventional manner and the outboard engines may have engine stops which are further spaced-apart to allow for a greater than +30 degrees steering range. In this variation, the engine stops may be configured to allow steering in the range of an angle of $30-\beta$ degrees in the steering direction 126 towards the centerline and $30+\beta$ degrees in the opposite steering direction 128. In this case, the center point for steering is adjusted, making the steering asymmetrical.

Figure 16:
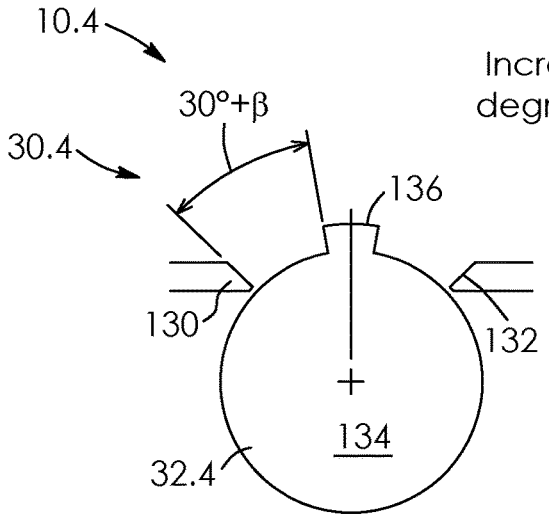
FIG. 16 is a simplified, top plan view of an outboard engine together with a mounting assembly according to a fifth aspect, the assembly having a pair of angle-setting members in the form of spaced-apart engine stops.
Figure 17:
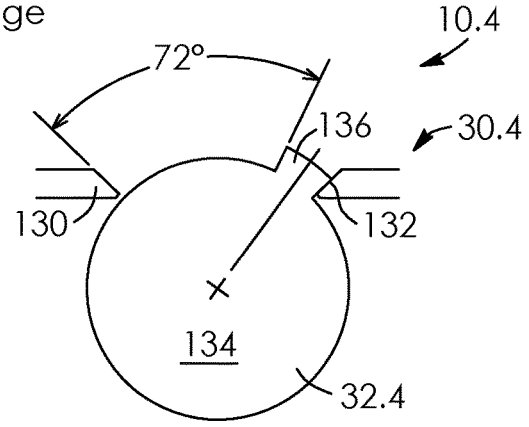
FIG. 17 is a simplified, top plan view of the engine and assembly of FIG. 16, the engine being fully turned in a hard over direction.

FIGS. 16 and 17 show a mounting assembly 30.4 and vessel 10.4 according to a fifth aspect. Like parts have like numbers and functions as the assembly 30 and vessel 10 shown in FIGS. 1 to 11 with the addition of "0.4". Typically engine stops are spaced-apart to allow an engine to have a steering range of ±30 degrees. An outboard engine 32.4 in this example has a pair of engine stops 130 and 132. The engine stops in this example are protrusions operatively connected to a transom and stern bracket (not shown). The engine 32.4 has a rotating part 134 with a protrusion 136 that selectively abuts the engine stops 130 and 132 at the outer steering ranges of the engine 32.4. In this variation, the angle-setting members are in the form of engine stops that are further spaced-apart, with the engine stops being altered when designing the engine to allow for a steering range of $\pm(30+\beta)$ degrees, which in this example equals to ±36 degrees. The embodiment of FIGS. 16 and 17 can be modified to provide a total steering range of 60 degrees. One side has $(60/2+12)=42$ degrees and the other side has $(60/2-12)=18$ degrees.

The forms of the angle-setting members as described herein may be referred to as means for positioning the outboard engines with a slight forward convergence.

The assembly 30 is shown in FIG. 3 with an upper angle-setting member 48 and a lower angle-setting member 50 in the form of wedges. However, it will be appreciated by a person skilled in the art that many further variations are possible within the scope of the invention described herein. For example, one angle-setting member may be used for each stern bracket instead of two spaced-apart members for each bracket. Alternatively, any number of wedge-shaped pieces may be used. For example, the two wedges could be made of one solid piece or four separate pieces in other embodiments.

The angle-setting members 48 and 52 may also be built into a jack plate mechanism. While the assembly 30 as described herein refers to two engines, the assembly as described herein may be used in conjunction with more than two engines in other embodiments. Alternatively, such an assembly 30 can be the engine mount which mates to the outboard engine midsection. For example, a metal engine mount is commonly used in pontoon or catamaran vessels.

It will be understood by a person skilled in the art that the mounting assembly is described herein with reference to outboard engines but that the mounting assembly may also be used with stern drive or inboard-outboard propulsion systems as well.

It will also be understood by a person skilled in the art that many of the details provided above are by way of example only and are not intended to limit the scope of the invention which is to be determined with reference to at least the following claims.

What is claimed is:

1. A marine vessel, comprising:

a first propulsion unit at a stern of the marine vessel, the first propulsion unit operable to exert on the marine vessel a first propulsion force along a first line of action, the first propulsion unit having a first steering range relative to the marine vessel, wherein when the first propulsion unit is positioned at a center of the first steering range and exerts the first propulsion force on the marine vessel, the first propulsion force has a first lateral component that is lateral relative to the marine vessel; and a second propulsion unit at the stern of the marine vessel, the second propulsion unit operable to exert on the marine vessel a second propulsion force along a second line of action, the second propulsion unit having a second steering range relative to the marine vessel, wherein when the second propulsion unit is positioned at a center of the second steering range and exerts the second propulsion force on the marine vessel, the second propulsion force has a second lateral component that is lateral relative to the marine vessel;

wherein the first and second propulsion units are positionable during operation of the marine vessel such that the first line of action intersects the second line of action along a longitudinal centerline of the marine vessel.

2. The marine vessel of claim 1, wherein:

the marine vessel has a longitudinal axis; and when the first propulsion unit is positioned at the center of the first steering range, and when the second propulsion unit is positioned at the center of the second steering range, the first and second lines of action are greater than 0 degrees and less than 30 degrees relative to the longitudinal axis of the marine vessel.

3. The marine vessel of claim 1, wherein:

the marine vessel has a longitudinal axis; and when the first propulsion unit is positioned at the center of the first steering range, and when the second propulsion unit is positioned at the center of the second steering range, the first and second lines of action are between 5 and 10 degrees relative to the longitudinal axis of the marine vessel.

4. The marine vessel of claim 1, wherein:

the marine vessel has a longitudinal axis; and when the first propulsion unit is positioned at the center of the first steering range, and when the second propulsion unit is positioned at the center of the second steering range, the first and second lines of action are 6 degrees relative to the longitudinal axis of the marine vessel.

5. The marine vessel of claim 1, wherein the first and second propulsion units are positionable during operation of the marine vessel such that the first line of action intersects the second line of action at a point of intersection forward of the first and second propulsion units and aft of a center of gravity of the marine vessel.

6. The marine vessel of claim 1, further comprising means for positioning the first and second propulsion units with a forward convergence.

7. The marine vessel of claim 1, further comprising:

a transom; and at least one first angle-setting member between the first propulsion unit and the transom, the at least one first angle-setting member biasing the first steering range laterally relative to the marine vessel.

8. The marine vessel of claim 7, further comprising at least one second angle-setting member between the second propulsion unit and the transom, the at least one second angle-setting member biasing the second steering range laterally relative to the marine vessel.

9. The marine vessel of claim 7, wherein the at least one first angle-setting member is wedge-shaped.

10. The marine vessel of claim 1, further comprising:

a transom; and a first stern bracket mounting the first propulsion unit to the transom, the first stern bracket biasing the first steering range laterally relative to the marine vessel.

11. The marine vessel of claim 10, further comprising a second stern bracket mounting the second propulsion unit to the transom, the second stern bracket biasing the second steering range laterally relative to the marine vessel.

12. The marine vessel of claim 1, further comprising a transom comprising a first angled portion, wherein the first propulsion unit is mounted to the first angled portion, and wherein the first angled portion biases the first steering range laterally relative to the marine vessel.

13. The marine vessel of claim 12, wherein the transom further comprises a second angled portion, wherein the second propulsion unit is mounted to the second angled portion, and wherein the second angled portion biases the second steering range laterally relative to the marine vessel.

14. The marine vessel of claim 1, wherein the marine vessel has a longitudinal axis and further comprises a first biased tiller arm operable to steer the first propulsion unit, and wherein, when the first biased tiller arm is parallel to the longitudinal axis, the first propulsion unit is positioned to exert on the marine vessel the first propulsion force having the first lateral component that is lateral relative to the marine vessel.

15. The marine vessel of claim 14, further comprising a second biased tiller arm operable to steer the second propulsion unit, wherein, when the second biased tiller arm is parallel to the longitudinal axis, the second propulsion unit is positioned to exert, on the marine vessel, the second propulsion force having the second lateral component that is lateral relative to the marine vessel.

16. The marine vessel of claim 1, further comprising first and second engine stops constraining steering of the first propulsion unit to the first steering range.

17. The marine vessel of claim 16, further comprising third and fourth engine stops constraining steering of the second propulsion unit to the second steering range.

18. The marine vessel of claim 1, wherein:

the first propulsion unit is operable to exert on the marine vessel the first propulsion force, the first propulsion force having (i) a first longitudinal component that is forward relative to the marine vessel and (ii) the first lateral component that is lateral relative to the marine vessel and towards a first side of the marine vessel; and the second propulsion unit is operable, while the first propulsion unit exerts on the marine vessel the first propulsion force having the first longitudinal component that is forward relative to the marine vessel and the first lateral component that is lateral relative to the marine vessel and towards the first side of the marine vessel, to exert on the marine vessel the second propulsion force, the second propulsion force having (i) a second longitudinal component that is rearward relative to the marine vessel and (ii) the second lateral component that is lateral relative to the marine vessel and towards the first side of the marine vessel.

19. A method of operating the marine vessel of claim 1, the method comprising:

causing the first propulsion unit to exert on the marine vessel the first propulsion force, the first propulsion force having (i) a first longitudinal component that is forward relative to the marine vessel and (ii) the first lateral component that is lateral relative to the marine vessel and towards a first side of the marine vessel; and causing the second propulsion unit to exert on the marine vessel the second propulsion force while the first propulsion unit exerts on the marine vessel the first propulsion force having the first longitudinal component that is forward relative to the marine vessel and the first lateral component that is lateral relative to the marine vessel and towards the first side of the marine vessel, the second propulsion force having (i) a second longitudinal component that is rearward relative to the marine vessel and (ii) the second lateral component that is lateral relative to the marine vessel and towards the first side of the marine vessel.

20. The method of claim 19, wherein the first line of action intersects the second line of action at a point of intersection forward of the first and second propulsion units and aft of a center of rotation of the marine vessel.

* * * * *